US005213129A

United States Patent [19]

Someah et al.

[11] Patent Number: 5,213,129

[45] Date of Patent: May 25, 1993

[54] FLUID MIXING DEVICE

[75] Inventors: Kaveh Someah, Milwaukee; Walter J. Baron, Mequon, both of Wis.

[73] Assignee: CSB Limited Partnership, Milwaukee, Wis.

[21] Appl. No.: 845,905

[22] Filed: Mar. 4, 1992

Related U.S. Application Data

[63] Continuation-in-part of Ser. No. 674,804, Mar. 25, 1991, Pat. No. 5,129,730.

[51] Int. Cl.[5] ..... E03B 7/07; B01F 15/04

[52] U.S. Cl. ..... 137/101.11; 137/564.5; 222/133; 222/145; 239/407; 366/160

[58] Field of Search ..... 366/160, 152, 162, 16, 366/17, 18; 137/205.5, 10.111, 564.5; 239/310, 398, 407; 222/133, 145

[56] References Cited

U.S. PATENT DOCUMENTS

| | | | |
|---|---|---|---|
| 2,227,646 | 1/1941 | Hillmann | 299/84 |
| 3,194,444 | 7/1965 | Hubert | 222/193 |
| 3,351,290 | 11/1967 | Baldwin | 239/276 |
| 3,384,103 | 5/1968 | Lansky | 137/205.5 |
| 3,392,753 | 7/1968 | Kleinmann | 137/564.5 |
| 3,556,141 | 1/1971 | Hind | 137/564.5 |
| 3,669,357 | 6/1972 | Overbey | 239/310 |
| 3,690,340 | 9/1972 | Sipin | 137/93 |
| 3,797,708 | 3/1974 | Sypal | 222/193 |
| 3,833,177 | 9/1974 | Pasley et al. | 239/201 |
| 3,968,932 | 7/1976 | Kimmell | 239/142 |
| 3,974,847 | 8/1976 | Hodges | 137/101.11 |
| 4,047,541 | 9/1977 | Mercier | 137/564.5 |
| 4,121,767 | 10/1978 | Jensen | 239/71 |
| 4,244,494 | 1/1981 | Colgate et al. | 222/1 |
| 4,354,762 | 10/1982 | Cantoni | 366/160 |
| 4,406,406 | 9/1983 | Knapp | 239/313 |
| 4,448,540 | 5/1984 | McLeod | 366/160 |
| 4,456,176 | 6/1984 | Agius | 239/142 |

*Primary Examiner*—Robert W. Jenkins
*Attorney, Agent, or Firm*—Quarles & Brady

[57] ABSTRACT

A fluid mixing valve has a canister which defines a chamber divided into an upper additive subchamber and a lower carrier subchamber by a plunger and diaphragm. A pressurized carrier liquid enters the carrier subchamber through an inlet and exits the carrier subchamber through a restriction, which produces a pressure differential across the plunger piston to pressurize a supply of additive liquid held within the additive subchamber above the piston. The pressurized additive liquid is injected past an adjustable metering valve into the flow stream of carrier liquid downstream of the restriction. As the additive liquid is depleted, the volume of the additive subchamber diminishes and the extension of the plunger out of the canister increases, to provide an indication of the amount of additive left in the additive subchamber. When the supply of additive liquid is exhausted, the plunger can be manually returned so as to enlarge the additive subchamber to prepare it to receive a new supply of additive liquid. The plunger can also be manually reciprocated when the additive subchamber is empty so as to clean out mineral deposits in the carrier subchamber.

13 Claims, 2 Drawing Sheets

FLUID MIXING DEVICE

This is a continuation-in-part of U.S. patent application Ser. No. 07/674,804 filed Mar. 25, 1991, now U.S. Patent No. 5,129,730, issued Jul. 14, 1992.

BACKGROUND OF THE INVENTION

This invention relates to devices for mixing fluids o±the type in which a metered amount of an additive liquid is dispensed to a flowing stream of a carrier liquid, and particularly but not limited to such a device for adding an additive liquid such as a fertilizer, herbicide or other type of fluid to a flowing stream of water.

DISCUSSION OF THE PRIOR ART

Fluid mixing devices for adding a metered quantity of an additive liquid to a flowing stream of a primary carrier liquid are well known. For example, such devices are commonly available in gardening stores for connection to the end of a garden hose. These devices typically have a canister for the additive liquid and a venturi created by the water flowing through a restriction in the device produces a vacuum which entrains the additive liquid through an orifice at a certain proportionate mixing ratio.

Other types of fluid mixing devices are also known. In one type, pressurized water is introduced into the device and passed through a series of flow restrictions. Water which does not flow through the flow restrictions is diverted downwardly to a pressure casing or jar which contains a central piston cylinder within which the additive liquid is held and which has a piston separating the additive liquid above it from the pressurized water below it. The additive liquid is pressurized in the piston cylinder and dispensed through a fixed orifice at the top of the piston cylinder into the flow of water downstream from the restrictors. From there, the mixture of additive liquid and water is dispensed out the nozzle of the device.

In such fluid mixing devices, the water in the pressure casing or jar which is intended to exert an upward pressure on the piston can become stagnated. If there is then even only a small amount of leakage of the additive liquid past the piston into the pressurized water held in the jar, the concentration of additive liquid in the stagnated water in the jar can become excessive. This can result in wasting the additive liquid or in accidental adverse consequences from dispensing or disposing of the overly concentrated mixture held in the jar. In addition, if the flow passage of the pressurized water to the jar becomes blocked, the additive liquid stops being dispensed into the flowing stream of water when the pressure on it subsides, although liquid (i.e. only water) would continue to be dispensed from the device. A user would not know this condition and therefore would be deceived into thinking that a mixture of the additive and the water was being dispensed, when in fact only the water was being dispensed. In addition, only water may be dispensed when the additive liquid supply has been depleted. Therefore it is desirable for the dispenser to provide an indication when the additive liquid supply has been depleted, so that it may be replenished.

In addition many areas of the country have water supplies with a substantial mineral content. Mineral deposits can quickly form in dispensers of the type described, which can interfere with their proper operation. Therefore it is desirable to provide an easy means for clearing mineral deposits from a dispenser.

SUMMARY OF THE INVENTION

The invention provides a fluid mixing device for dispensing a metered quantity of an additive liquid to a flowing stream of a carrier liquid which overcomes the above disadvantages. The device has a chamber within a canister and a diaphragm dividing the chamber into an additive subchamber on an additive side of the diaphragm and a carrier subchamber on a carrier side of the diaphragm. An inlet is in the canister for connection to a source of pressurized carrier liquid and opens into the carrier subchamber upstream of the carrier subchamber. An outlet in the canister is for dispensing a flow of a mixture of the additive liquid and the carrier liquid and a flow passage provides communication between a restriction which is downstream of the carrier subchamber and the outlet. The carrier subchamber forms an unrestricted flow passage of the carrier liquid between the inlet and the flow restriction and metering means provide communication between the additive subchamber and the flow passage for dispensing a metered amount of additive liquid from the additive subchamber to the flow of carrier liquid in the flow passage.

With this construction, the diaphragm forms a seal between the additive subchamber and the carrier subchamber which allows the subchambers to vary in relative volume as additive liquid is dispensed and is not susceptible to degradation by mineral deposits. In addition, the carrier liquid in the carrier subchamber is constantly turning over with fresh water and does not become stagnated.

In an especially useful aspect, the diaphragm is movable by a plunger which extends outside of the canister and is mounted for reciprocation relative to the canister so as to vary the amount of extension of the plunger outside of the canister in accordance with the volume of the additive subchamber. Thereby, a visual indication is given of the amount of additive liquid in the additive subchamber and of whether the additive liquid supply needs to be replenished.

Preferably, the plunger is adapted for manual reciprocation of the plunger. Manually reciprocating the plunger flexes the diaphragm so as to dislodge mineral deposits which may form on the carrier side of the diaphragm, which may otherwise cause the diaphragm to bind or adversely affect the flexibility of the diaphragm during operation. This feature also allows returning the diaphragm to a position so as to enlarge the additive subchamber to prepare it for refilling.

In an especially useful form, the chamber has an outer cylindrical wall, the plunger has a piston between the additive subchamber and the carrier subchamber and the diaphragm spans between the piston and the outer cylindrical wall of the chamber. The piston helps guide the plunger as the plunger reciprocates in normal operation and when being manually reciprocated, and this construction also provides for a readily manufacturable unit made of largely cylindrical and tubular parts that can be readily molded or fabricated.

DETAILED DESCRIPTION OF THE PREFERRED EMBODIMENTS

Figure 1:
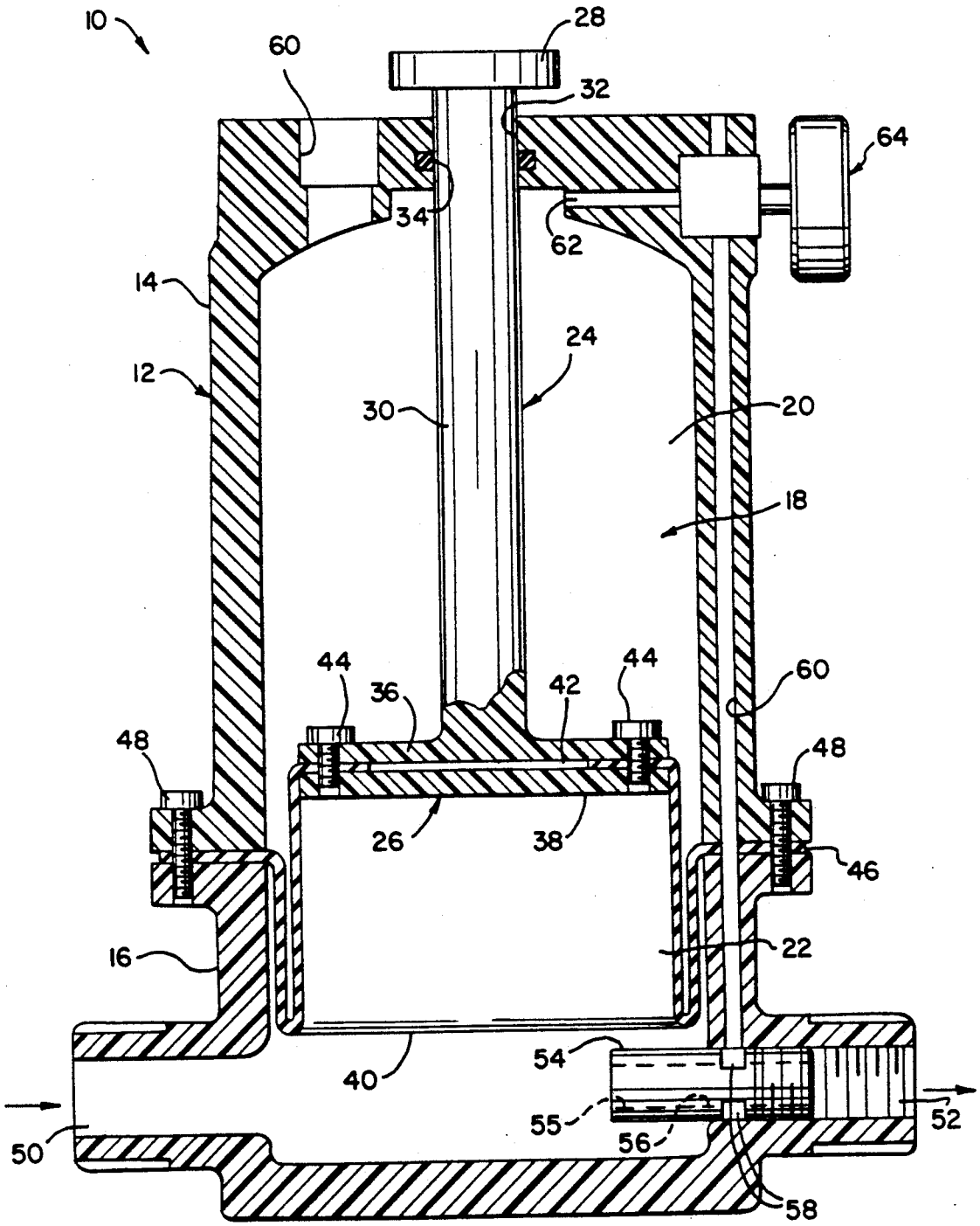
FIG. 1 is a cross-sectional view of a fluid mixing device of the invention.

A fluid mixing device of the same general type as that described herein is described in U.S. patent application Ser. No. 07/674,804 entitled "Fluid Mixing Device" filed Mar. 25, 1991, now issued as U.S. Pat. No. 5,129,730, on Jul. 14, 1992, and said description is hereby incorporated by reference. FIG. 1 illustrates a fluid mixing device 10 of the present invention. The device 10 includes a generally cylindrical canister 12, preferably made of molded plastic, having an upper housing 14 and a lower housing 16. Cylindrical chamber 18 is divided into an additive subchamber 20 defined by the upper housing 14 and a carrier subchamber 22 defined by the lower housing 16.

A plunger 24 having a piston 26 at its lower end and a handle 28 at its upper end has a shank 30 between the piston 26 and handle 28 which extends through a bore 32 in the top of the upper housing 14. An o-ring 34 forms a sliding seal between the shank 30 and the bore 32. The piston 26 is formed by a flange 36 integrally molded at the lower end of the shank 30 and a facing plate 38.

A diaphragm 40 made of any suitable flexible elastomeric material, resides between the piston 26 and the canister 12 and forms a sliding seal between the piston 26 and the canister 12. The diaphragm 40 has a hole 42 through its center and the edges of the diaphragm 40 adjacent to the hole 42 are sandwiched by the piston 26 between the flange 36 and the facing plate 38. Fasteners 44 secure the facing plate 38 to the flange 36 and compress the edges of the diaphragm 40 so as to create a fluid tight seal thereat between the additive subchamber 20 and the carrier subchamber 22. In addition, the diaphragm 40 has an outer diameter edge 46 which is sandwiched by the canister 12 between the upper housing 14 and the lower housing 16. Fasteners 48 secure the upper and lower housing 14 and 16 together and compress the outer edges 46 of the diaphragm 40 so as to create a fluid tight seal between the additive subchamber 20 and the carrier subchamber 22 at the outer edges of the diaphragm. Therefore, the additive subchamber 20 and the carrier subchamber 22 are sealed off from one another so that no fluid can pass form one subchamber to the other past the piston 26, but the piston 26 can slide up and down which varies the relative volumes of the subchambers 20 and 22.

The lower housing 16 has a carrier inlet 50 which is adapted for connection to a source of pressurized carrier liquid, such as a city water supply, and a mixture outlet 52. The mixture outlet 52 is internally threaded to receive a flow restrictor 54 which can be screwed into the outlet 52 from the outside thereof. The restrictor 54 has an internal bore 56 with a smaller flow area than the inlet 50 so as to create a restriction 55 at its inner end and therefore a pressure drop from the carrier subchamber 22 to the mixture outlet 52.

The bore 56 also creates a flow passage from the restriction 55 to the outlet 52. The restrictor 54 has side openings 58 in communication with the flow passage of the bore 54 which may be positioned so that one or more of them are in communication with an additive passageway 60 formed in the canister 12 sidewall and which extends through the diaphragm 40.

The passageway 60 is placed in communication with a passageway 62 by a metering valve 64 of the same type as the metering valve described in the aforementioned U.S. patent application Ser. No. 07/674,804. The top of the upper housing 14 also has an inlet bore 68 which is provided with a removable plug (not shown) to allow filling the additive subchamber 20 with an additive liquid desired to be dispensed into the carrier liquid.

In operation, carrier liquid under pressure is admitted through inlet 50 and fills carrier subchamber 22. The carrier liquid in the subchamber 22 tends to urge the plunger 24 upwardly since the pressure in the carrier subchamber 22 is higher than the pressure in the additive subchamber 20. The plunger 24 will move upwardly as additive liquid is pressed out of the subchamber 20 past the metering valve 64 in a metered amount as determined by the setting of the metering valve 64. Additive liquid held in the subchamber 20 will therefore be squeezed out of the subchamber 20 past the metering valve 64 and into the stream of carrier liquid flowing through the restrictor 54 to be mixed therein and dispensed out the outlet 52.

Since the plunger 24 moves up and down in accordance with the amount of additive held within the subchamber 20, the plunger 24 provides an indication of when the additive subchamber 20 is empty and needs to be refilled. In addition, since the plunger 24 can be manually moved up and down within the chamber 18 when the canister 12 is substantially empty, it can be manually reciprocated to clean the diaphragm 40 of mineral deposits which may build up on its surface facing the carrier subchamber 22. This is important so that the deposits do not become so built up that they interfere with the flexibility of the diaphragm 40 which could prevent the additive from being squeezed out of the subchamber 20 under the normal operation of the dispenser 10. In addition, the reciprocable mounting of the plunger 24 relative to the canister 12 allows the piston 26 to be manually returned to near the bottom of the chamber 18 for refilling the additive subchamber 20 with additive liquid through the inlet hole 68.

However, the plunger need not necessarily extend outside of the canister. If not, but indication of empty state is still desired, a short rod or "button" (not shown) may be provided in the top of the canister which would be pushed out by the plunger when the plunger approached being empty, for example within about ½" of the top of the stroke of the plunger. An extended button would signal an empty additive chamber. The friction caused by an o-ring provided around the button between the bottom and the canister would be sufficient to hold the button in place until contact. Upon refilling, the button would be pushed down manually to return it to the retracted, non-empty, position.

Figure 2:
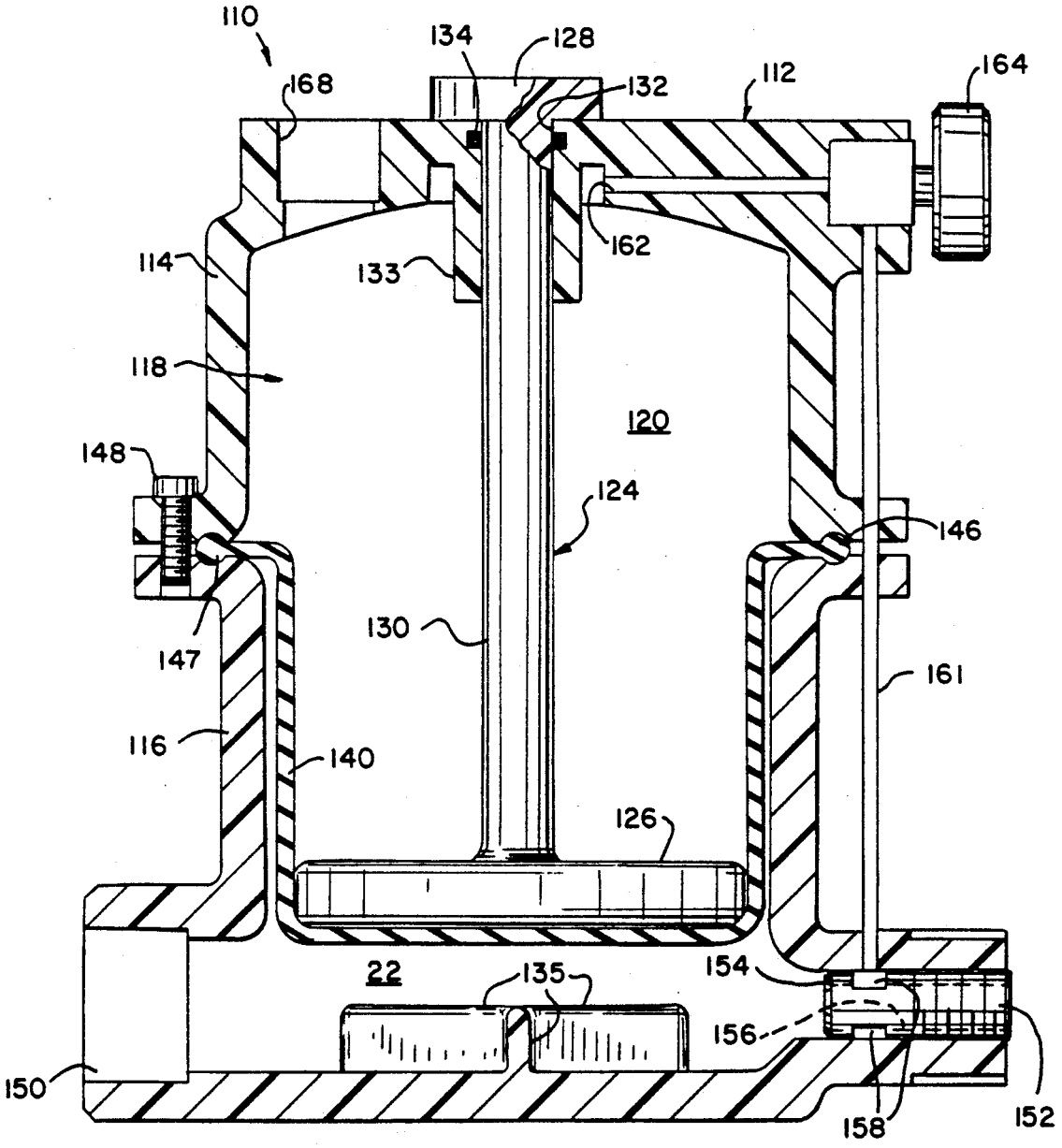
FIG. 2 is a cross-sectional view of a second embodiment of a fluid mixing device of the invention.

A second embodiment 110 of a fluid mixing device of the invention is illustrated in FIG. 2. This embodiment is essentially the same as the embodiment 10, and analogous elements are identifed in the embodiment 110 by the same reference number as in the embodiment 10, plus 100.

The main difference between the embodiment 110 and the embodiment 10 is that in the embodiment 110 the outer edge 146 of the diaphragm 140 is captured between the upper housing 114 and the lower housing 116 at approximately the longitudinal center of the cylinder chamber 118 so that the diaphragm 140 is extended downwardly when the additive subchamber 120 is filled. This reduces the chance that the diaphragm 140 could fold over the lower face of the plunger 124 onto itself, which would shorten its useful life.

Other differences between the embodiment 110 and the embodiment 10 are that the diaphram 140 has a bead 147 along its outer edge to secure a positive engagement and seal between the diaphragm 140 and the upper and lower housings 114 and 116, and the diaphragm 140 extends uninterrupted across the face of the plunger 124, obviating a need for making a seal between the diaphragm 140 and the plunger 124. Additional guidance is provided for the plunger 124 by flange 133, and passageway 160 is provided through a tube 161 exterior of the canister 112. In addition, flow deflector/reinforcement ribs 135 are molded into the bottom wall of the lower housing 116.

Many modifications and variations of the preferred embodiments will be apparent to those of ordinary skill in the art. For example, the restrictor 54 could be integrally molded into the outlet 52. In addition, the canister and plunger need not necessarily be made of plastic molded materials, but could be made of any structurally sound fluid tight materials. Therefore, the invention should not be limited to the scope of the embodiments described, but only by the claims which follow.

We claim:

1. A fluid mixing device for dispensing a metered quantity of an additive liquid to a flowing stream of a carrier liquid, comprising:

a canister;

a chamber within said canister;

means including a diaphragm within said chamber, said means dividing said chamber into an additive subchamber on an additive side of said diaphragm and a carrier subchamber on a carrier side of said diaphragm;

an inlet in said canister for connection to a source of pressurized carrier liquid, said inlet opening into said carrier subchamber upstream of said carrier subchamber;

an outlet in said canister for dispensing a flow of a mixture of the additive liquid and the carrier liquid;

a flow restriction downstream of said carrier subchamber;

a flow passage providing communication between said restriction and said outlet;

wherein said carrier subchamber forms an unrestricted flow passage of the carrier liquid between the inlet and the flow restriction; and metering means providing communication between said additive subchamber and said flow passage for dispensing a metered amount of additive liquid from said additive subchamber to the flow of carrier liquid in the flow passage.

2. A flow mixing device as in claim 1, wherein said means includes a plunger, said plunger extending outside of the canister and mounted for reciprocation relative to said canister so as to vary the amount of extension of the plunger outside of said canister in accordance with the volume of said additive subchamber.

3. A fluid mixing device as in claim 2, wherein said plunger has a handle outside of said canister for manual reciprocation of said plunger.

4. A fluid mixing device as in claim 2, wherein the chamber has an outer cylindrical wall, the plunger has a piston between the additive subchamber and the carrier subchamber and the diaphragm spans between the piston and the outer cylindrical wall of the chamber.

5. A fluid mixing device as in claim 1, wherein said metering means includes an adjustable valve for selectively varying the proportionate mixture of additive liquid to carrier liquid which is dispensed from the device.

6. A fluid mixing device as in claim 1, wherein said plunger extends outside of said canister and has a handle for moving the piston to increase the volume of the additive subchamber and reduce the volume of the carrier subchamber so as to return the plunger to a refill position.

7. A fluid mixing device as in claim 1, wherein said diaphragm is extended when said additive subchamber is filled.

8. A fluid mixing device for dispensing a metered quantity of an additive liquid to a flowing stream of a carrier liquid, comprising:

a canister;

a chamber within said canister;

a piston reciprocable within said chamber, said piston dividing said chamber into an additive subchamber on an additive side of said piston and a carrier subchamber on a carrier side of said piston;

an inlet to said carrier subchamber in said canister for connection to a source of pressurized carrier liquid;

an outlet in said canister for dispensing a flow of a mixture of the additive liquid and the carrier liquid;

a flow restriction upstream of said outlet;

a flow passage providing communication between said restriction and said outlet;

wherein said carrier subchamber forms an unrestricted flow passage of the carrier liquid between the inlet and the flow restriction; and metering means providing communication between said flow passage and said additive subchamber for dispensing a metered amount of additive liquid from said additive subchamber to the flow of carrier liquid in the flow passage.

9. A fluid mixing device as in claim 8, further comprising a diaphragm which in cooperation with said piston divides said chamber into an additive subchamber on an additive side of said piston and a carrier subchamber on a carrier side of said piston so as to prohibit fluid communication past said piston between said additive and carrier subchambers.

10. A fluid mixing device as in claim 9, wherein the chamber has an inner cylindrical wall, the piston has a circular outer surface and the diaphragm spans between the circular outer surface of the piston and the inner cylindrical wall of the chamber.

11. A fluid mixing device as in claim 9, wherein the diaphragm is positioned relative to said chamber so that said diaphragm is extended when said additive subchamber is filled.

12. A flow mixing device as in claim 8, further comprising a shank extending from said piston outside of the canister and mounted to reciprocate with said piston relative to said canister so as to vary the amount of extension of the shank outside of said canister in accordance with the volume of said additive subchamber.

13. A fluid mixing device as in claim 12, further comprising a handle on said shank outside of said canister for manual reciprocation of said piston.

* * * * *